US006119998A

United States Patent [19]

Anselmo

[11] Patent Number: 6,119,998

[45] Date of Patent: Sep. 19, 2000

[54] DEVICE FOR PROTECTING A CARPET FROM AN ARTICLE OF FURNITURE

[76] Inventor: Anthony Gray Anselmo, 177 Main St., Harwich, Mass. 02645

[21] Appl. No.: 09/311,874

[22] Filed: May 14, 1999

[51] Int. Cl.[7] ..... B65D 19/00

[52] U.S. Cl. ..... 248/346.11; 411/457; 411/480

[58] Field of Search ..... 248/346.11; 411/488, 411/489, 457, 469, 473, 480

[56] References Cited

U.S. PATENT DOCUMENTS

| | | | |
|---|---|---|---|
| 2,944,366 | 7/1960 | Joabson | 248/346.11 |
| 4,056,251 | 11/1977 | Dixon et al. | 248/346.11 X |
| 5,681,023 | 10/1997 | Sheydayi | 248/346.11 X |
| 5,743,506 | 4/1998 | Adams | 248/346.11 |
| 5,823,492 | 10/1998 | Anselmo | 248/346.11 X |

*Primary Examiner*—Ramon O. Ramirez
*Attorney, Agent, or Firm*—Steven N. Fox; Hancock & Estabrook, LLP

[57] ABSTRACT

A device for protecting a carpet and underlying pad from an article of furniture. In one embodiment, the device comprises an mounting portion having an upper cavity and a bottom surface. The upper cavity is enclosed by a plurality of walls and has a substantially planar floor surface. The bottom surface is substantially planar. The device further comprises a plurality of support members engaged with and extending from the bottom surface. Each of the support members comprise a conical shaped portion, a leg portion and a terminal portion. The conical shaped portion comprises first and second ends which define an overall length L1. The conical shaped member further comprises a diameter D1 along its length L1. The first end of the conical shaped portion is engaged with the bottom surface of the mounting portion. The leg portion comprises a first and second ends defining an overall length L2. The leg portion has a diameter D2. The first end of the leg portion is engaged with the second end of the conical shaped portion. The diameter D2 of the leg portion is substantially less than the diameter D1 along the length L1 of the conical shaped portion. The terminal portion comprises first and second ends defining an overall length L3. The terminal portion has a diameter D3. The first end of the terminal portion is engaged with the second end of the leg portion. The diameter D3 of the terminal portion decreases in diameter along the length L3 from the first end of the terminal portion to the second end of the terminal portion. The diameter D3 is substantially less than the diameter D2 of the leg portion.

3 Claims, 1 Drawing Sheet

DEVICE FOR PROTECTING A CARPET FROM AN ARTICLE OF FURNITURE

FIELD OF THE INVENTION

The present invention relates generally to devices for protecting a carpet. More particularly, the present relates to a device which protects a carpet from articles of furniture which lie on the carpet.

BACKGROUND OF THE INVENTION

Carpets are comprised of a soft woven pile material (i.e, strands of fabric with a surface of upright yarns) which is adhesively bounded to a relatively stiff backing material. When laying a carpet on a floor, a resilient pad if often first placed over the area of the floor which the carpet is to be laid. The carpet is then positioned and laid upon the pad such that the backing material is in contact with the pad and the pile material is facing upward. When an article of furniture is laid on the carpet for a period of time, the pile and backing material of the carpet and the underlying pad become deformed thereby resulting the degradation of the carpet and pad.

SUMMARY OF THE PRESENT INVENTION

The primary object of the present invention is to provide a device which will prevent deformation of the carpet and pad when an article of furniture laid upon the device.

The present invention is a device for protecting a carpet and underlying pad from an article of furniture. In one mbodiment, the device comprises an mounting portion having an upper cavity and a bottom surface. The upper cavity is enclosed by a plurality of walls and has a substantially planar floor surface. The bottom surface is substantially planar. The device further comprises a plurality of support members engaged with and extending from the bottom surface. Each of the support members comprise a conical shaped portion, a leg portion and a terminal portion. The conical shaped portion comprises first and second ends which define an overall length L1. The conical shaped member further comprises a diameter D1 along its length L1. The first end of the conical shaped portion is engaged with the bottom surface of the mounting portion. The leg portion comprises a first and second ends defining an overall length L2. The leg portion has a diameter D2. The first end of the leg portion is engaged with the second end of the conical shaped portion. The diameter D2 of the leg portion is substantially less than the diameter D1 along the length L1 of theconical shaped portion. The terminal portion comprises first and second ends defining an overall length L3. The terminal portion has a diameter D3. The first end of the terminal portion is engaged with the second end of said leg portion. The diameter D3 of the terminal portion decreases in diameter along the length L3 from the first end of the terminal portion to the second end of the terminal portion. The diameter D3 is substantially less than the diameter D2 of the leg portion.

BRIEF DESCRIPTION OF THE DRAWINGS

The following detailed description of the present invention will be better understood with reference to the accompanying drawings in which.

DETAILED DESCRIPTION OF THE PREFERRED EMBODIMENTS

Figure 1:
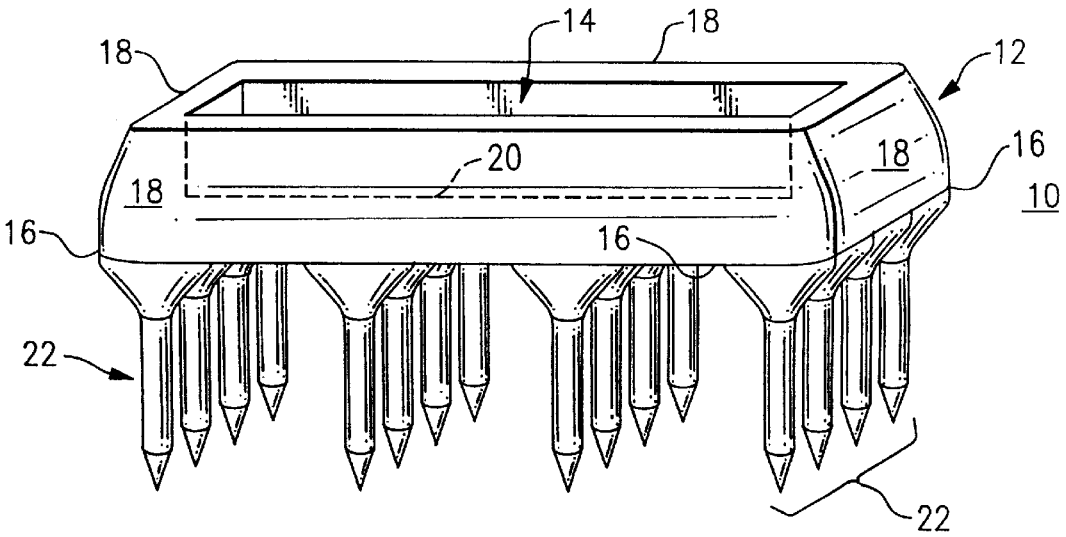
FIG. 1 is a perspective view of the present invention.
Figure 2:
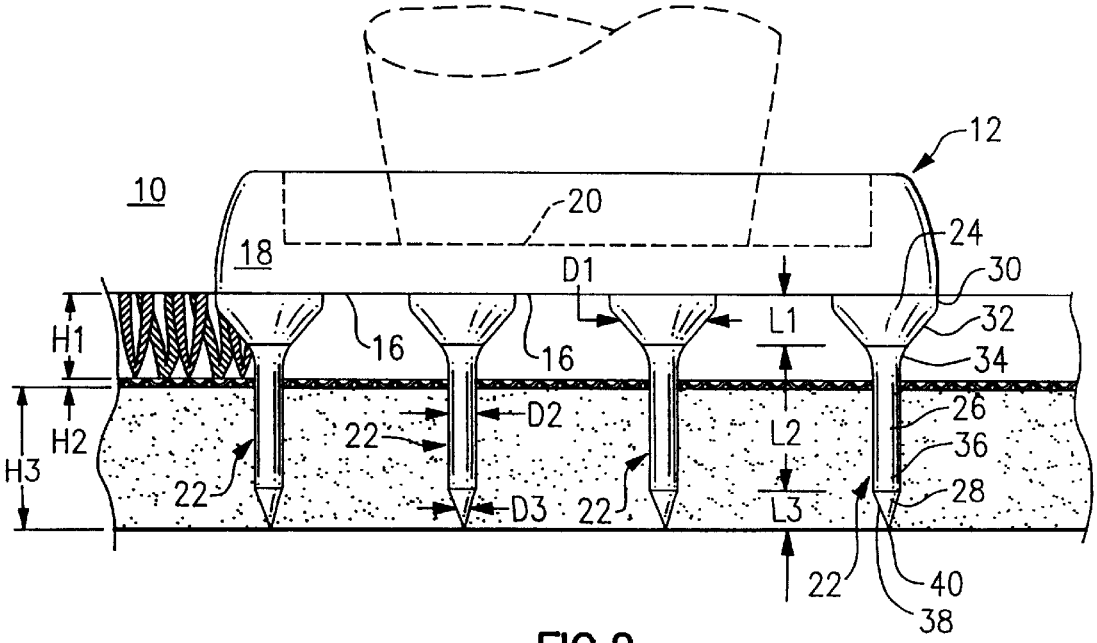
FIG. 2 is a side view of the present invention showed operatively disposed upon a carpe and underlying pad and having an article of furniture mounted thereon.

Referring to FIGS. 1 and 2, the device 10 is shown operatively engaged with a carpet 11 having a pile material 13 and a backing material 15, and an underlying pad 17. The carpet has a pile materal thickness of H1 and a backing material of thickness H2 and the pad has a thickness of H3.

The device 10 generally comprises a mounting portion 12 having an upper cavity 14 and a bottom surface 16. The upper cavity 14 is enclosed by a plurality of side walls 18 and has a substantially planar floor surface 20. The bottom surface 16 is substantially planar. The device 10 further comprises a plurality of support members 22 engaged with and extending from the bottom surface 16. Each of the support members 22 comprise a conical shaped portion 24, a leg portion 26, and a terminal portion 28.

The conical shaped portion 24 comprises first and second ends 30 and 32 which define an overall length L1. The conical shaped member 24 further comprises a diameter D1 along its length L1. The diameter D1 decreases from a preferred diameter of about 0.200 inches at first end 30 to a diameter of about 0.100 at second end 32. The first end 30 of the conical shaped portion 24 is engaged with the bottom surface 16 of the mounting portion 12.

The leg portion 26 comprises first and second ends 34 and 36 defining an overall length L2. The leg portion 26 has a diameter D2. The first end 34 of the leg portion 26 is engaged with the second end 32 of the conical shaped portion 24. The diameter D2 of the leg portion 26 is substantially less than the diameter D1 along the length L1 of the conical shaped portion 24. The diameter D2 of the leg portion 26 preferably decreases from a preferred diameter of about 0.100 inches at first end 34 to a diameter of about 0.065 at second end 36.

The terminal portion 28 comprises first and second ends 38 and 40 defining an overall length L3. The terminal portion 28 has a diameter D3. The first end of the terminal portion 28 is engaged with the second end 36 of the leg portion 26. The diameter D3 of the terminal portion 28 decreasess in diameter along the length L3 from a diamyter of about 0.065 at the first end 38 of the terminal portion to substantially a point at the second end 40 of the terminal portion 38. The diameter D3 of the terminal portion 28 is substantially less than the diameter D2 of the leg portion 26.

To prevent unwanted deformation of the carpet and pad, the length L1 of the concial shaped portion 24 is preferably less than the thickness H1 of the pile material of the carept. The combined length L2 and L3 of the leg portion 26 and terminal portion 28 should be longer than the combined thickness H2 of the backing material and the thickness H3 of the pad. In many applications, the length L1 of the concial shaped portion 24 is preferably about 0.250 inches. The length L2 of the leg portion 26 is preferably about 0.270 inches. The length of the terminal portion 28 is preferably about 0.150 inches.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for protecting a carpet and underlying pad from an article of furniture, the device comprising:

a mounting portion having an upper mounting cavity and a bottom surface, said upper cavity being enclosed by a plurality of walls and having a substantially planar surface, said bottom surface being substantially planar;

a plurality of support members engaged with and extending from said bottom surface, each of said support members comprise a conical shaped portion, a leg portion and a terminal portion;

said conical shaped portion comprises first and second ends which define an overall length L1, said conical shaped portion further comprising a diameter D1 along said length L1, said first end of said conical shaped portion is engaged with said bottom surface of said mounting portion;

said leg portion comprises first and second ends defining an overall length L2, said leg portion has a diameter D2, said first end said of said leg portion is engaged with said second end of said conical shaped portion, said diameter D2 of said leg portion is substantially less than said diameter D1 along said length L1 of said conical shaped portion; and said terminal portion comprises first and second ends defining an overall length L3, said terminal portion has a diameter D3, said first end of said terminal portion is engaged with said second end of said leg portion, said diameter D3 decreases in diameter along said length L3 from said first end of said terminal portion to said second end of said terminal portion, said diameter D3 is substantially less than said diameter D2 of said leg portion.

2. A device for protecting a carpet and underlying pad from an article of furniture, the device comprising a one-piece unitary molded member, said one-piece unitary molded member comprising a mounting portion having an upper mounting cavity and a bottom surface, said upper cavity being enclosed by a plurality of walls and having a substantially planar surface, said bottom surface being substantially planar; said one-piece unitary molded member further comprises a plurality of support members each comprising a conical shaped portion, a leg portion and a terminal portion; each of said conical shaped portions comprise first and second ends which define an overall length L1, said conical shaped portion further comprising a diameter D1 along said length L1, said first end of said conical shaped portion is engaged with said bottom surface of said mounting portion, each of said leg portions comprise first and second ends defining an overall length L2 having a diameter D2, said first end of said leg portion is molded with said second end of said conical shaped portion, said diameter D2 of said leg portion is substantially less than said diameter D1 along said length L1 of said conical shaped portion; and each of said terminal portions comprise first and second ends defining an overall length L3, said terminal portion has a diameter D3, each of said first ends of said terminal portion is engaged with said second end of said leg portion, said diameter D3 decreases in diameter along said length L3 from said first end of said terminal portion to said second end of said terminal portion, said diameter D3 is substantially less than said diameter D2 of said leg portion.

3. The device of claim 2, wherein said diameter D1 of said conical shaped portion decreases from about 0.200 inches to 0.100 inches and diameter D2 decreases from about 0.100 inches to about 0.065 inches.

* * * * *